United States Patent [19]

Bromberg

[11] 4,220,075

[45] Sep. 2, 1980

[54] METHOD OF MAKING A SLIDE CALCULATOR

[75] Inventor: Howard M. Bromberg, Bronx, N.Y.

[73] Assignee: The Flexi-Group, Inc., New York, N.Y.

[21] Appl. No.: 944,281

[22] Filed: Sep. 21, 1978

Related U.S. Application Data

[62] Division of Ser. No. 701,082, Jun. 30, 1976, Pat. No. 4,132,348.

[51] Int. Cl.[2] ..... B65D 27/04

[52] U.S. Cl. ..... 93/1 F; 93/63 M

[58] Field of Search ..... 93/1 R, 1 F, 63 M; 229/75; 35/39, 75; 235/70 R, 89 R

[56] References Cited

U.S. PATENT DOCUMENTS

| | | | |
|---|---|---|---|
| 1,525,696 | 2/1925 | Spencer | 35/75 |
| 1,666,337 | 4/1928 | McDade | 35/75 |
| 2,335,713 | 11/1943 | Vogel | 35/75 X |
| 2,632,963 | 3/1953 | Drury | 35/39 |

*Primary Examiner*—Robert D. Baldwin
*Attorney, Agent, or Firm*—Philip Rodman

[57] ABSTRACT

A construction comprising a sheet of two contiguous detachable leaf members is folded and separated to form slide and sleeve components of the calculator. Fold lines in the sheet are formed parallel to a separation or tear line that divides one leaf member from the other leaf member. In assembling the slide calculator the leaf members can be separated before or after the folding operation. A marginal portion provided on one of the leaf members enables the sheet to be secured by adhesive or other suitable form of attachment to a newspaper or magazine, a package container, or a package label. In various embodiments of the invention an information readout is provided on reverse sides of the calculator including one embodiment wherein the printed format of the slide and sleeve components is applied to one surface only of the respective leaf members. The slide calculator construction can be produced from a web that is successively divided into sheet members of predetermined size comprising the pair of contiguous leaf members, with simultaneous formation of the fold lines and the separation line in the direction of movement of the web.

8 Claims, 15 Drawing Figures

Fig. 2.
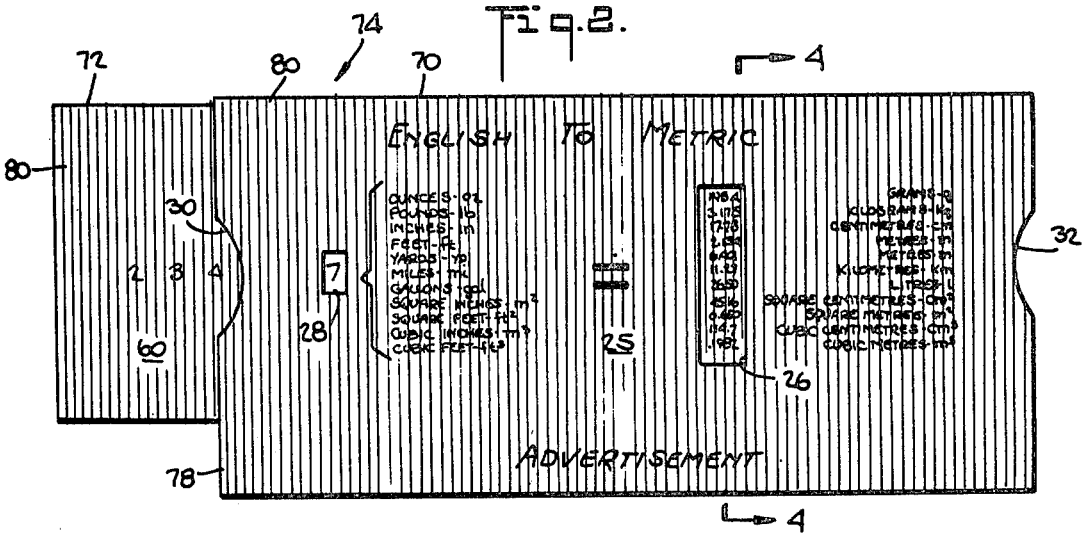
Fig. 3.
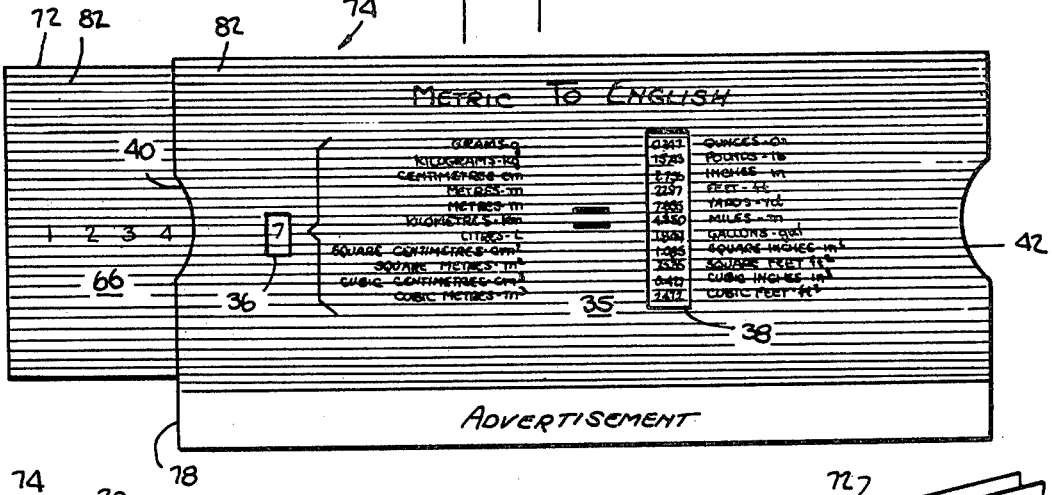
Fig. 4.
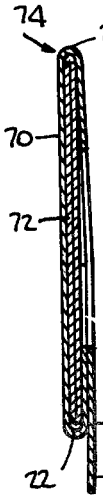
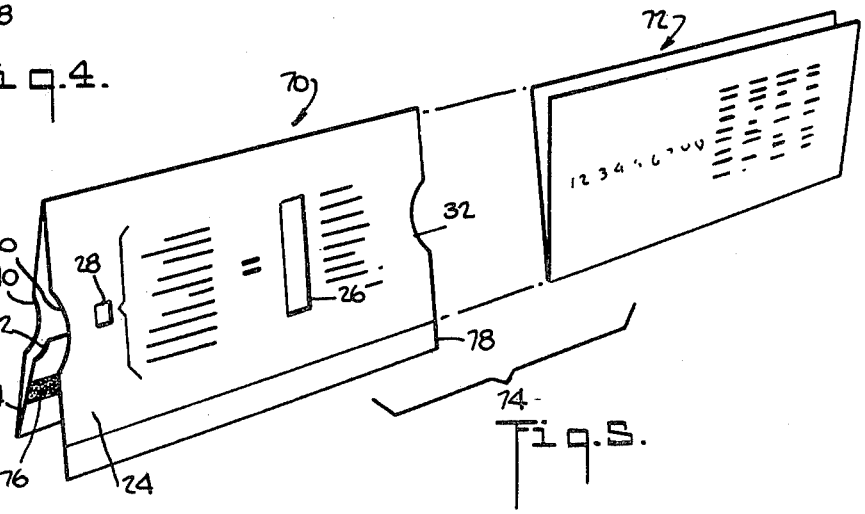
Fig. 5.

Fig. 6.
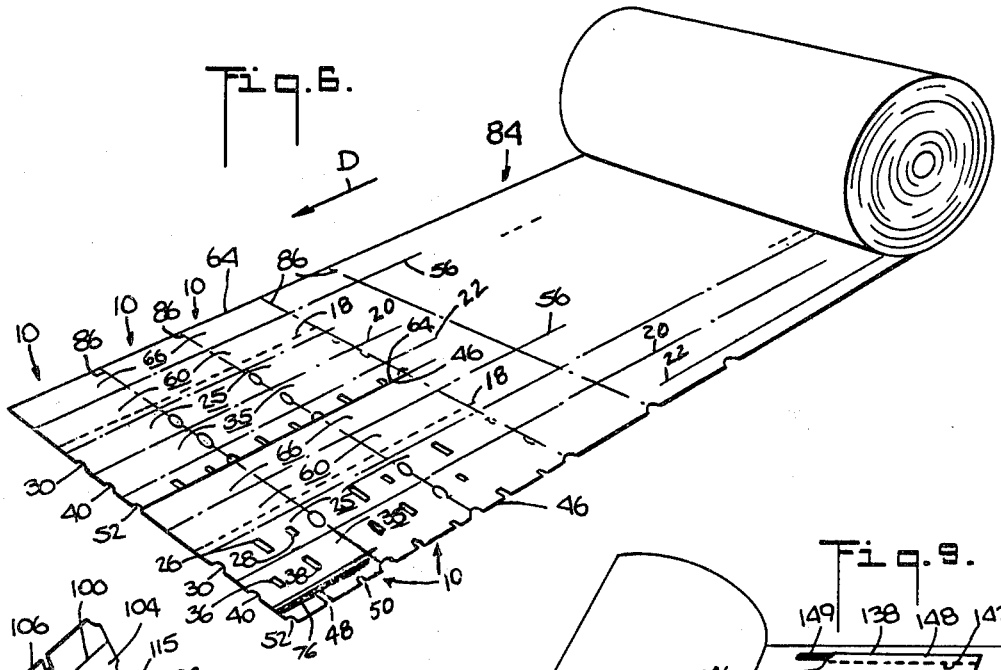
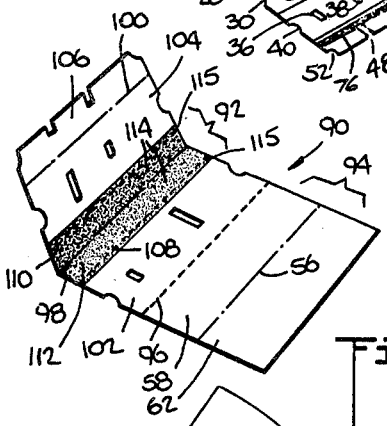
Fig. 7.
Fig. 9.
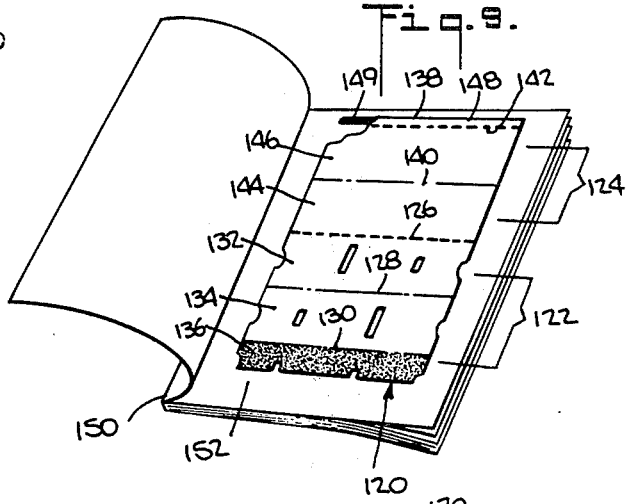
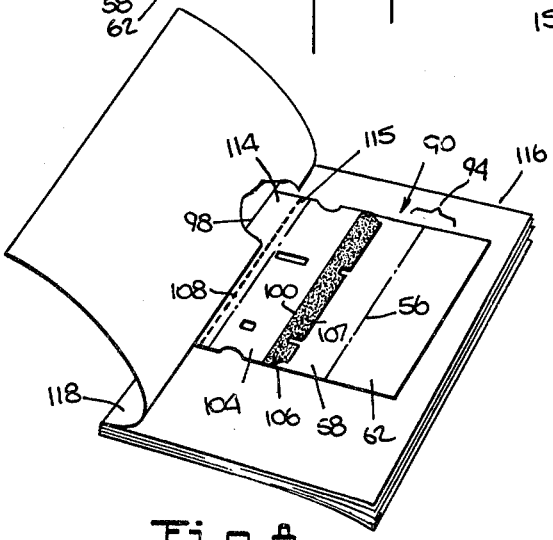
Fig. 8.
Fig. 10.
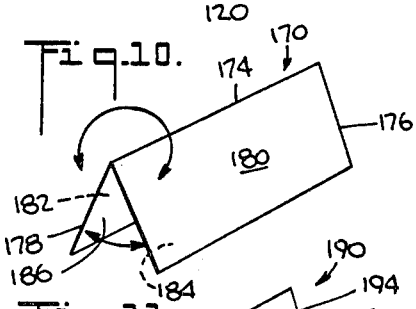
Fig. 11.
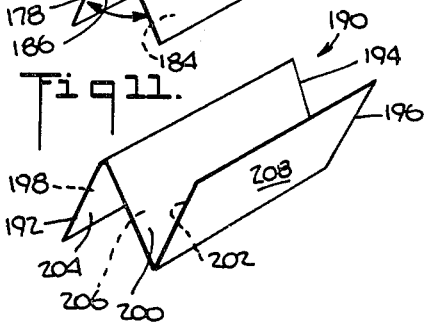

METHOD OF MAKING A SLIDE CALCULATOR

This application is a divisional of my co-pending application Ser. No. 701,082 filed June 30, 1976 now U.S. Pat. No. 4,132,348, issued Jan. 2, 1979.

This invention is directed to slide calculators and more particularly to a novel construction for and method of making a slide calculator.

Slide calculators comprising a slide member movably accommodated in a sleeve or slide holder are well known. The slide holder is usually furnished with a readout section such as an aperture or window to permit selective viewing of a portion of the slide member. When the slide member is placed in a predetermined data input position the readout section of the slide holder normally provides a simultaneous display of the desired data output. This simplicity of operation makes the slide calculator an appealing device to work with.

Slide calculators can be adapted to display numerical information, as in a known concrete volume calculator, or verbal information, as in a known first-aid procedure guide. The range of application of slide calculators in furnishing numerical or verbal information is apparently unlimited.

Since slide calculators are handy informational tools that can ordinarily be used repeatedly over extended periods of time they are also a popular means for advertising. However the present manufacturing cost of slide calculators often dictates against large gratuitous distributions of the device by an advertiser, merchant or promoter. Usually an advertiser, for example, will offer a specific type of slide calculator as a gift on a limited basis to selected customers or clients. It is also common practice for slide calculators to be sold by merchants to the consumer, especially those calculators which serve as teaching instruments, such as the device disclosed in U.S. Pat. No. 2,632,963.

In view of the appeal that slide calculators have in providing numerical and verbal information, as well as in serving as an advertising or promotional device, it is desirable to provide a slide calculator of simple, novel construction which can be manufactured at a low enough cost to make feasible large gratuitous offerings of the calculator by an advertiser, merchant or promotor.

Among the several objects of the present invention may be noted the provision of a novel slide calculator, a novel construction for a slide calculator, a novel slide calculator having a foldable slide member with at least two data panels, a novel slide calculator having an information readout on reverse sides of the calculator yet formed from a single sheet member having printed matter on one surface only, a novel construction for a slide calculator having a marginal portion for detachable securance of the calculator to a journal such as a newspaper or magazine, to a package container, or to a package label, a novel slide calculator wherein associated data panels on the slide member and sleeve member have respective corresponding colors to indicate such association, a novel slide calculator having an opaque sleeve member with predetermined non-opaque areas to permit viewing of discrete areas of the slide member, and a novel method for making a slide calculator. Other objects and features will be in part apparent and in part pointed out hereinafter.

The present invention relates to a novel construction and method for making a slide calculator. In one embodiment the construction comprises a first leaf member divided into three elongated sleeve segments by two substantially parallel fold lines, and a second leaf member divided into two elongated slide segments by another fold line, the leaf members being detachably secured at a separation, tear or score line that is parallel to each fold line. The first leaf member is folded at its fold lines to overlap the sleeve segments and thereby form a sleeve component having opposite exteriorly exposed data panels. If desired an adhesive substance can be provided on one or more selected sleeve segments to secure the folded segments together. The second leaf member is folded along its fold line to overlap the slide segments and thereby form a slide component having at least two exteriorly exposed data panels. The second leaf member, which forms the slide component, can be detached from the first leaf member, either before or after the folding operation, and is slidably accommodated in the folded sleeve component for relative movement between the components. The association of a particular exteriorly exposed slide member data panel with a particular exteriorly exposed sleeve member data panel becomes apparent through color correspondency of the slide and sleeve data panels. Under this arrangement the slide calculator construction, including the contiguous detachable leaf members, is simple enough to be partially or fully assembled by an ultimate user.

In other embodiments of the invention a marginal portion can be provided on either leaf member for securing the slide calculator construction to a newspaper or magazine, and to a package container or package label.

In further embodiments of the invention the second leaf member includes four or six data panels that permit folding of the leaf member in various ways to provide different combinations of exteriorly exposed data panels.

In still other embodiments of the invention the sleeve component is substantially opaque and includes predetermined non-opaque areas to permit viewing of discrete areas of the slide component in obtaining an information readout.

Various embodiments of the invention furnish an information readout on reverse sides of the calculator including one embodiment wherein the printed format of the slide and sleeve components is applied to one surface only of the sheet member. Substantial manufacturing cost savings are thus accomplished with one-surface printing in relation to the manufacturing costs of known reverse readout calculators.

The slide calculator construction is preferably made in quantity from a web that is successively divided into sheet members of predetermined size comprising the contiguous first and second leaf members. The fold lines and separation line in each leaf member are formed in the direction in which the web moves, thereby permitting simultaneous and continuous formation of the fold lines and separation line prior to cutting of the web into individual sheet members. Any desired glue or adhesive portions can also be provided in continuous fashion in the direction of web movement.

The invention accordingly comprises the constructions and methods hereinafter described, the scope of the invention being indicated in the following claims.

In the accompanying drawings in which various possible embodiments of the invention are shown:

FIG. 2 is a plan view showing one readout side of a slide calculator assembled from the development of FIG. 1;

FIG. 3 is a plan view of a readout on the reverse side thereof;

FIG. 4 is a sectional view thereof taken on the line 4—4 of FIG. 2;

FIG. 5 is an exploded perspective view thereof;

FIG. 6 is a web on which the FIG. 1 development is formed;

FIG. 7 is another embodiment of my invention;

FIG. 8 shows the FIG. 7 embodiment partially folded and secured to the binding of a journal;

FIG. 9 is another embodiment of my invention shown secured to a page in a journal;

FIGS. 10–11 show two embodiments of a slide component; and

Corresponding reference characters indicate corresponding parts throughout the several views of the drawings.

Figure 1:
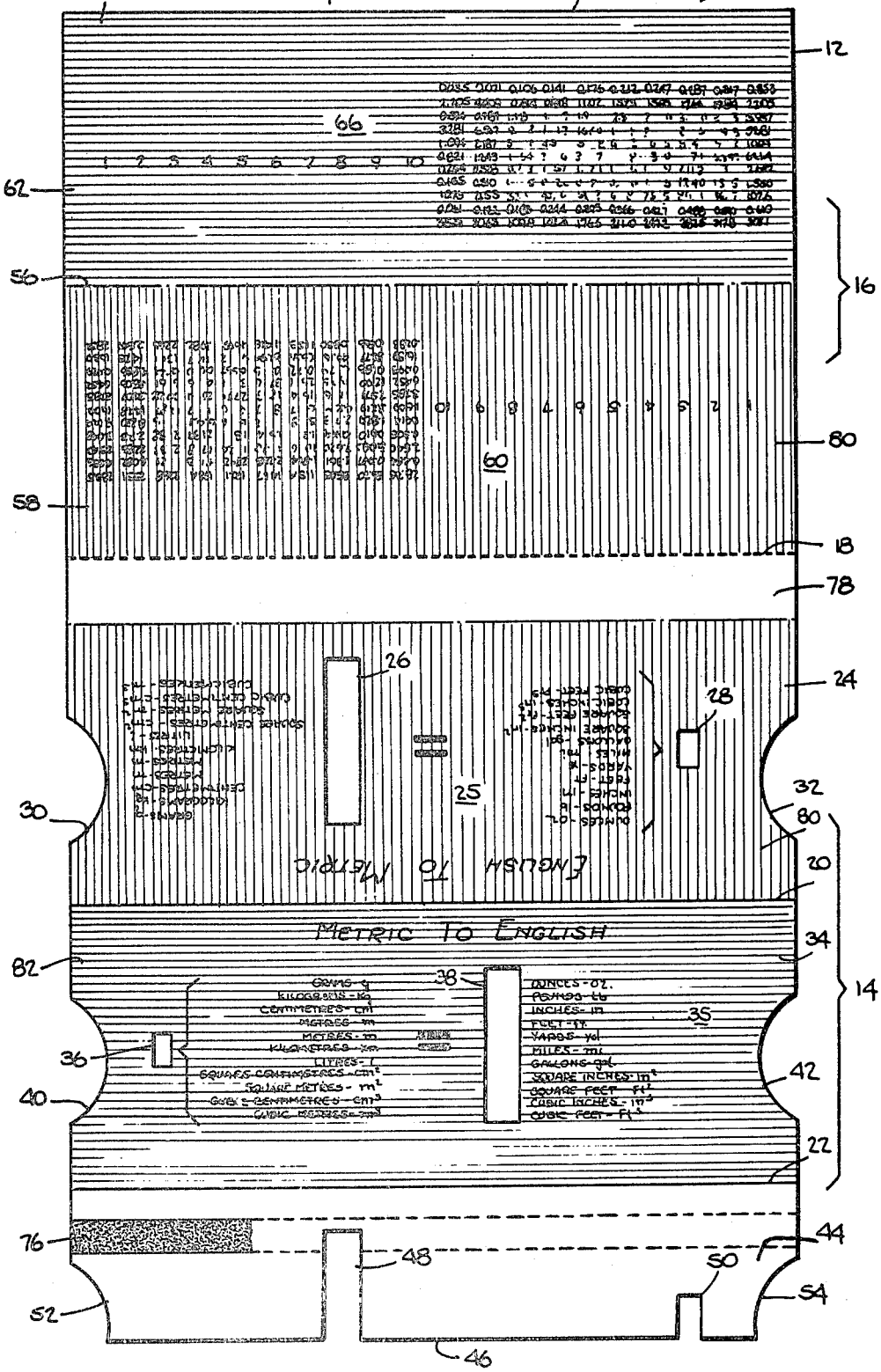
FIG. 1 is a development of one embodiment of my invention.

Referring now to the drawings, a construction for a slide calculator incorporating one embodiment of my invention is generally indicated by the reference number 10 in FIG. 1.

The construction 10 comprises an elongated generally rectangular sheet member 12 formed of paper, lightweight paper board or other suitable, flexible, foldable material. The sheet member 12 includes first and second leaf members 14 and 16 detachable at a tear, separation or score line 18.

The first leaf member 14 is provided with spaced fold lines 20 and 22 formed parallel to the separation line 18. It should be noted that the term fold line does not necessarily denote a printed line but can be an impression or other suitable formation in the sheet member 12 to facilitate folding. A sleeve segment 24, defined between the separation line 18 and the fold line 20, includes a data panel 25, readout aperture windows 26 and 28, and opposite curved indentations 30 and 32. Another sleeve segment 34, defined between the fold lines 20 and 22 includes a data panel 35, readout aperture windows 36 and 38, and opposite curved indentations 40 and 42. Still another sleeve segment 44, defined between the fold line 22 and a free edge 46 includes cutout portions 48 and 50 formed at the free edge 46, and opposite curved indentations 52 and 54.

The second leaf member 16 is provided with a fold line 56 formed parallel to the separation line 18. A slide segment 58 defined between the separation line 18 and the fold line 56 includes a data panel 60. Another slide segment 62 defined between the fold line 56 and a free edge 64 includes a data panel 66.

The construction 10 can be assembled by folding the leaf members 14 and 16 along the fold lines 20, 22 and 56 prior or subsequent to separation of the leaf members along the separation line 18. The leaf member 14 is folded along the fold lines 20 and 22 such that the sleeve segments 24, 34 and 44 overlap to form a sleeve component 70, with the sleeve data panels 25 and 35 being arranged to face outwardly as shown in FIGS. 2, 3 and 5. The cutout portions 48 and 50 respectively align with the readout aperture windows 26 and 28.

Although not required, a strip or stripe of pressure sensitive tape 76 (FIG. 1), a stripe of adhesive or gum, or other suitable securing means can be provided on the segment 44 to bond the segments 24 and 44 of the folded sleeve component 70 together. The cutout portions 48 and 50 on the segment 44 respectively align with the readout aperture windows 26 and 28 on the segment 24. Alignment is also obtained of the curved indentations 30, 40, 52 and 32, 42, 54.

The leaf member 16 is folded along the fold line 56 such that the slide segments 58 and 62 overlap to form a slide component 72 with the slide data panels 60 and 66 being arranged to face outwardly as shown in FIGS. 2, 3 and 5.

As most clearly shown in FIG. 4, the inside width of the folded sleeve component 70 between the fold lines 20 and 22 exceeds the outside width of the folded slide component 72 by a predetermined amount to permit slidable accommodation of the slide component 72 in the sleeve component 70. The assembly of the slide component 72 in the sleeve component 70 constitutes a slide calculator generally indicated by the reference number 74.

The sleeve segment 24 on the folded sleeve component 70 includes a marginal portion 78 that can be used to display advertising indicia, data, or other suitable information. However since the slide calculator 74 is operable without the marginal portion 78, said marginal portion can be eliminated if desired.

As shown in FIG. 2 the sleeve data panel 25 and the slide data panel 60 cooperate to provide a conversion from English to metric units. On the reverse side of the calculator, as shown in FIG. 3, the sleeve data panel 35 and the slide data panel 66 cooperate to provide a conversion from metric to English units. The association between the data panels 25 and 60 is indicated by a color 80 which coats the data panels 25 and 60 or a portion thereof. Similarly a color 82 on the data panels 35 and 66 indicates an association therebetween.

In operating the slide calculator 74, the slide component 72 is moved to a suitable position within the sleeve component 70 to present a desired data input in the aperture window 28 or 36 (FIGS. 2 and 3). A corresponding simultaneous dislay of output data is provided at the aperture window 26 or 38.

The construction 10 is preferably made on a web 84 (FIG. 6) arranged to move in the direction D. The fold lines 20, 22 and 56, the separation line 18, and the optional glue line or tape stripe 76 are continuously formed in the direction D in a known manner. The data panels 25, 35, 60 and 66 are printed or otherwise applied on one surface of the web 84 as are the colors 80 and 82. Dies or punches or other suitable equipment (not shown) can be used to form the aperture windows 26, 28, 36, 38, the cutouts 48, 50 and the curved indentations 30, 32, 40, 42, 52, 54. The web 84 is cut along the lines 86 to obtain the individual sheet members 12. The longitudinal side edges 46 and 64 of the web 84 correspond to the free edges 46 and 64 of the individual sheet members 12. The web 84 is thus ideally suited for manufacturing large quantities of the construction 10 since all operations can be continuously performed as the web moves in the direction D, with the printing operation being performed on one surface only. Material waste is minimized since the side edges of the web correspond to the free edges of the construction 10 and no trimming is required.

In another embodiment of my invention a construction 90, shown in FIG. 7, includes a first leaf member 92 and a second leaf member 94 detachable at a separation line 96. The first leaf member 92 is provided with spaced fold lines 98 and 100 formed parallel to the separation line 96. A sleeve segment 102 is defined between the separation line 96 and the fold line 98, and a sleeve segment 104 is defined between the fold lines 98 and 100. The window apertures and indentations (shown but not numbered) in the sleeve segments 102 and 104 are identical to those of the construction 10. A sleeve segment 106 adjoining the sleeve segment 104 is identical to the sleeve segment 44 of the construction 10.

Although data panels on the leaf members 92 and 94 are not shown for the sake of clarity, said leaf members include data panels similar to the data panels of the construction 10.

The leaf member 92 includes respective marginal separation lines 108 and 110 provided at equivalent predetermined distances from the sleeve fold line 98. A stripe of pressure adhesive 112, or other suitable bonding agent, is provided in marginal portions 114, 114 defined between the sleeve fold line 98 and the marginal separation lines 108 and 110. The adhesive stripe 112 should be of a width that extends slightly beyond the separation lines 108 and 110 to define marginal fringe portions 115, 115. The second leaf member 94 of the construction 90 is identical to the leaf member 16 of the construction 10.

The construction 90 is assembled in a preliminary form, as shown in FIG. 8, by folding the sleeve segments 102 and 104 at the fold line 98. The marginal portions 114, 114 are thus folded against themselves as are the marginal fringe portions 115, 115 and bonded together by the pressure adhesive 112. The marginal fringe portions 115, 115 thus constitute inner marginal portions with respect to the marginal portions 114, 114 which constitute outer marginal portions. The outer marginal portions 114, 114 of the construction 90 can be secured to a journal 116 at its binding 118 by adhesion, stapling or other suitable form of affixation for delivery to the journal recipient. The segment 106 can be folded under the segment 104 (not shown) or left unfolded with any suitable protective layer (not shown) covering the adhesive portion 107 if such adhesive is desired. The construction 90 is then removed from the journal 116 by tearing along the overlapped scorelines 108 and 110, for detachment from the marginal portions 114, 114.

The sleeve segments 102 and 104 remain bonded together at the inner marginal portions 115,115 after separation from the outer marginal portions 114,114. The amount by which the adhesive stripe 112 extends beyond the separation lines 108 and 110 is predetermined to permit the sleeve segments to remain bonded together after separation from the outer marginal portions 114,114. The construction 90 is then assembled into slide and sleeve components (not shown). For example the sleeve segment 106 is folded at the fold line 100 and overlapped against the sleeve segment 102 to form a sleeve component (not shown) analogous to the sleeve component 70. The leaf member 94 is folded at its fold line 56 to form a slide component analogous to the slide component 72. It has been noted that the leaf member 92 can be separated from the leaf member 94 before or after the folding operation. The slide component is then receivable in the sleeve component to form a slide calculator (not shown) analogous to the calculator 74.

In another embodiment of my invention a construction 120 shown in FIG. 9 includes a first leaf member 122 and a second leaf member 124 detachable at a separation line 126. The first leaf member 122 is provided with fold lines 128 and 130 formed parallel to the separation line 126 and includes sleeve segments 132, 134, 136. The sleeve segments 134 and 136 are identical to the sleeve segments 34 and 44 respectively of the construction 10. The sleeve segment 132 is analogous to the sleeve segment 24 of the construction 10 but does not have a marginal portion 78. The distance between the separation line 126 and the fold line 128 is approximately equivalent to the distance between the fold lines 128 and 130.

The second leaf member 124 which extends from the separation line 126 to a free edge 138 includes a fold line 140 and a tear line 142 spaced from the free edge 138. A slide segment 144 defined between the fold line 140 and the separation line 126 is identical to the slide segment 58. A slide segment 146 defined between the fold line 140 and the free edge 138 includes a marginal portion 148 intermediate the edge 138 and the tear line 142, and is otherwise analogous to the slide segment 62 of the construction 10. The distance between the fold line 140 and the tear line 142 is approximately equivalent to the distance between the fold line 140 and the separation line 126.

The construction 120 can be combined with a journal 150 by, for example, securing the marginal portion 148 with adhesive 149 or other suitable attaching means to a page 152. The recipient of the journal 150 can detach the construction 120 from the page 152 at the tear line 142. The construction 120 is then assembled in the manner previously described to form slide and sleeve components (not shown) analogous to the components 70 and 72.

Figure 12:
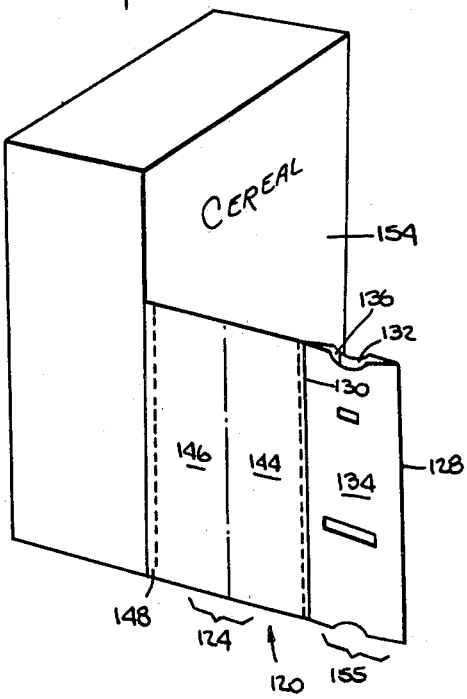
FIGS. 12–15 are perspective views showing package containers and package labels incorporating my invention.
Figure 13:
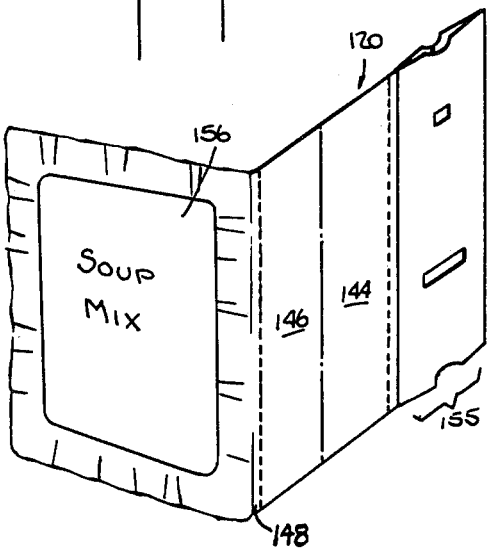

The construction 120 is ideally suited for combination with various containers or packages such as for example, by securing the marginal portion 148 to the package 154 in FIG. 12. Similarly the marginal portion 148 can be secured to the package 156 in FIG. 13. If desired the leaf member 122 can be prefolded into a sleeve 155 analogous to the sleeve 70 to shorten the extent of the construction 120 on the packages 154 and 156. The construction 120 can also be formed integral with a package or container as for example by printing a blank of the construction 120 directly onto the package 154 (not shown).

Figure 14:
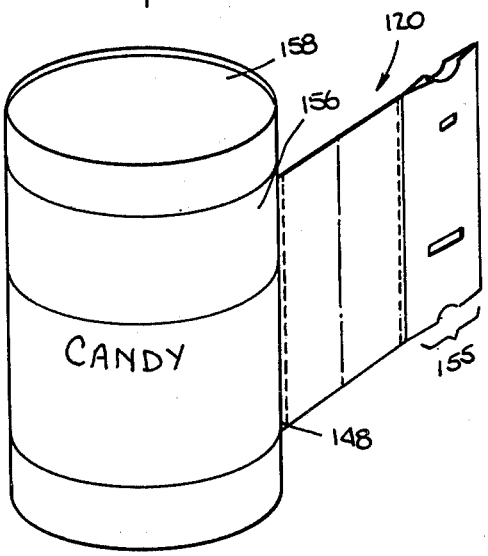
Figure 15:
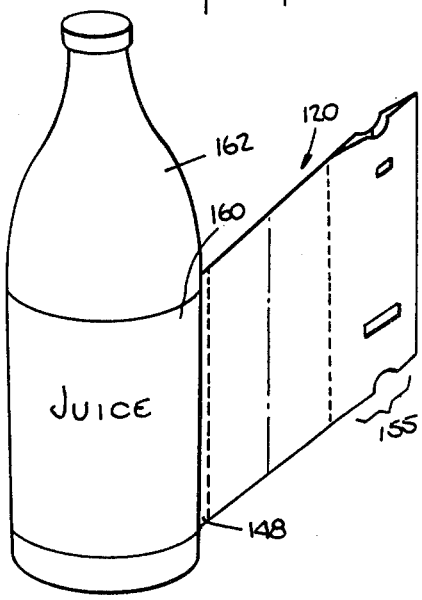

As shown in FIGS. 14 and 15 the construction 120 is also especially suited for combination with various package labels such as for example by securing the marginal portion 148 to the label 156 of a package 158. Similarly the marginal portion 148 can be secured to a label 160 of a container 162. The construction 120 can also be formed integral with the labels 156 and 160 in any suitable known manner. Prefolding of the leaf member 122 into the sleeve 155 is optional.

In another embodiment of my invention as shown in FIG. 10 a slide component 170 is formed with a fold line 174 to define slide segments 176 and 178. Data panels 180, 182, 184 and 186, the details of which are not shown, are applied to respective surfaces of the segments 176 and 178. In addition the surfaces 180 and 184 have color associations (not shown) with one of the readout data panels of a sleeve component such as the sleeve 70 whereas the surfaces 182 and 186 have color associations with the other readout data panel on the sleeve component.

The informational yield of a slide calculator employing the slide component 170 having four data panels is effectively doubled in comparison with a slide calculator incorporating the slide component 72 which has two data panels. The slide component 170 is easily incorporated in a construction (not shown) analogous to the construction 10 as for example by substituting the slide component 170 for the leaf member 16 in the construction 10.

Although not shown, a slide component having four data panels can also be obtained by printing on one surface of a slide component having four slide segments.

In still another embodiment of my invention as shown in FIG. 11 a slide component 190 is folded into three slide segments 192, 194 and 196 having data panels 198, 200, 202, 204, 206 and 208 printed or otherwise applied to both sides of the segments 192, 194 and 196. The slide component 180 is thus foldable three different ways to provide three different combinations of outwardly exposed data panels such as 198–200, 202–204 and 206–208. The respective color associations of the slide segment data panels 198–208 with selected readout data panels in a sleeve component such as the sleeve component 70 are applied in the manner previously described. Under this arrangement a slide calculator incorporating the slide component 180 has an information yield that effectively triples the information yield of a slide calculator formed from the construction 10. The slide component 190 is easily incorporated in a construction (not shown) analogous to the construction 10 as for example by substituting the slide component 190 for the leaf member 16, in the construction 10.

As will be apparent to those skilled in the art the readout aperture windows of the sleeve component need not be cut out but can be formed as non-opaque areas on a material that is substantially opaque in all other areas of the sleeve segments. Although the web 84 accommodates formation of a double row of the constructions 10, the web width can be sized to accommodate formation of any number of rows of the construction 10.

Some advantages of the novel invention disclosed herein include a lightweight, one-piece slide calculator construction that is easily folded and divided to form slide and sleeve components, and a slide calculator that can be made from a web in a low cost, low waste operation having economies which permit gratuitous distribution of the slide calculator construction for advertising and/or promotional purposes.

In view of the above it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of making a slide calculator comprising, dividing a foldable sheet member of predetermined size into at least two contiguous, generally rectangular leaf members, forming a line of separation on the sheet member to render the leaf members detachable from one another, providing one of the leaf members with at least two folding lines parallel to the line of separation to divide the one leaf member into three sleeve segments, with the spacing between the fold lines in the sleeve member being selected to provide at least two contiguous sleeve segments with substantially equal width, providing the other leaf member with at least one folding line parallel to the line of separation to divide the other leaf member into two slide segments, providing data portions on at least one of said sleeve segments and one of said slide segments, providing means on said one of said sleeve segments to permit correlation of the data portion on said one of said sleeve segments with the data portion on said one of said slide segments, detaching the one leaf member from the other leaf member at the line of separation, folding the one leaf member along its fold lines such that the sleeve segments overlap to form a sleeve component, folding the other leaf member along its fold line such that the slide segments overlap to form a slide component, the respective predetermined sizes of the leaf members and the spacing between the fold lines on each leaf member being selected to permit slidable accommodation of the folded slide component in the folded sleeve component, and assembling the slide component in the sleeve component to permit correlation of the data portion on said one of said sleeve segments with the data portion on said one of said slide segments.

2. The method of claim 1 wherein the step of providing data portions further comprises the formation of respective first and second sleeve data panels on said two contiguous sleeve segments on one surface of the sheet member, and the simultaneous formation of first and second slide data panels on the two slide segments on the one surface of the sheet member, the sleeve data panels and the slide data panels being arranged to face outwardly during the folding of the respective leaf members into the sleeve and slide components, and wherein the step of providing means to correlate the data portions further comprises the formation of a viewing zone on each of the two contiguous sleeve segments to permit a view of the slide component data panels through the two sleeve segments during slidable accommodation of the folded slide component in the folded sleeve component to obtain an information readout at the respective viewing zones on reverse sides of the calculator.

3. The method of claim 2 wherein the data correlation step further includes indicating an association between one slide segment data panel and one sleeve segment data panel with a first color applied to the one data panels and indicating an association between the other slide segment data panel and the other sleeve segment data panel with a second color applied to the other data panels.

4. The method of claim 1 wherein the step of providing data portions further includes forming third and fourth slide data panels on the two slide segments on the opposite surface of the sheet members for respective association with the first and second sleeve data panels.

5. The method of claim 1 wherein the data correlation step further comprises making the sleeve component substantially opaque with predetermined non-opaque areas to permit viewing of discrete areas of the slide component when the slide component is slidably accommodated in and moved with respect to the sleeve component.

6. A method of making a slide calculator comprising unwinding a web of predetermined lateral extent from a roll of foldable sheet material, continuously forming a separation line in the longitudinal direction of the web to divide the web longitudinally into elongated first and second leaf portions, continuously forming at least one longitudinal fold line in one of the leaf portions to define at least two longitudinal sleeve segment portions of substantially equal width, the fold line being formed substantially parallel to the longitudinal separation line, continuously forming at least one longitudinal fold line in the other leaf portion to define two longitudinal slide segment portions, and repetitively applying informational data portions on one surface of the web at the two slide segment portions and at the two sleeve segment portions to provide a plurality of connected slide calculator blanks on said web of foldable sheet material, providing means on at least one of said sleeve segments to permit correlation of the data portion on said one of said sleeve segments with the data portion on at least one of said slide segments, laterally cutting the web at predetermined longitudinal spaced locations to form individual generally rectangular sheet members at predetermined longitudinal extent having a lateral extent corresponding to the lateral extent of the web, detaching the one leaf member from the other leaf member of each sheet member at the line of separation, folding the one leaf member along its fold lines such that the sleeve segments overlap to form a sleeve component, folding the other leaf member along its fold line such that the slide segments overlap to form a slide component, the respective predetermined sizes of the leaf members and the spacing between the fold lines on each leaf member being selected to permit slidable accommodation of the folded slide component in the folded sleeve component, and assembling the slide component in the sleeve component to permit correlation of the data portion on said one of said sleeve segments with the data portion on said one of said slide segments.

7. The method of claim 6 further including continuously forming a second longitudinal fold line in the one leaf portion to define a third longitudinal sleeve segment portion.

8. The method of claim 7 further including applying at least one adhesive stripe to the one surface of the web on the third longitudinal sleeve segment portion in the longitudinal direction of the web parallel to the separation line.

* * * * *